United States Patent [19]

Rosecrans

[11] Patent Number: 4,647,317

[45] Date of Patent: Mar. 3, 1987

[54] MANUFACTURING PROCESS TO REDUCE LARGE GRAIN GROWTH IN ZIRCONIUM ALLOYS

[75] Inventor: Peter M. Rosecrans, Niskayuna, N.Y.

[73] Assignee: The United States of America as represented by the Department of Energy, Washington, D.C.

[21] Appl. No.: 636,659

[22] Filed: Aug. 1, 1984

[51] Int. Cl.[4] ..... C22F 1/18

[52] U.S. Cl. ..... 148/11.5 F; 148/133

[58] Field of Search ..... 148/11.5 F, 133, 421

[56] References Cited

U.S. PATENT DOCUMENTS 3,111,475 11/1963 Davidson ..... 376/451
3,131,129 4/1964 Morrison ..... 376/451
3,291,698 12/1966 Fortescue ..... 376/451
3,413,196 11/1968 Fortescue et al. ..... 376/451
3,442,761 5/1969 Feraday ..... 376/451
3,645,800 2/1972 Molk et al. ..... 148/11.5 F
4,452,648 6/1984 Cheadle et al. ..... 148/11.5 F

FOREIGN PATENT DOCUMENTS 85553 8/1983 European Pat. Off. ..... 148/11.5 F

*Primary Examiner*—Christopher W. Brody
*Attorney, Agent, or Firm*—Judson R. Hightower; Richard E. Constant

[57] ABSTRACT

A method of treating cold-worked zirconium alloys to reduce large grain growth during thermal treatment at temperatures above the recrystallization temperature of the alloy comprising heating the cold-worked alloy between about 1300°-1350° F. for 1 to 3 hours prior to treatment above its recrystallization temperature.

12 Claims, 1 Drawing Figure

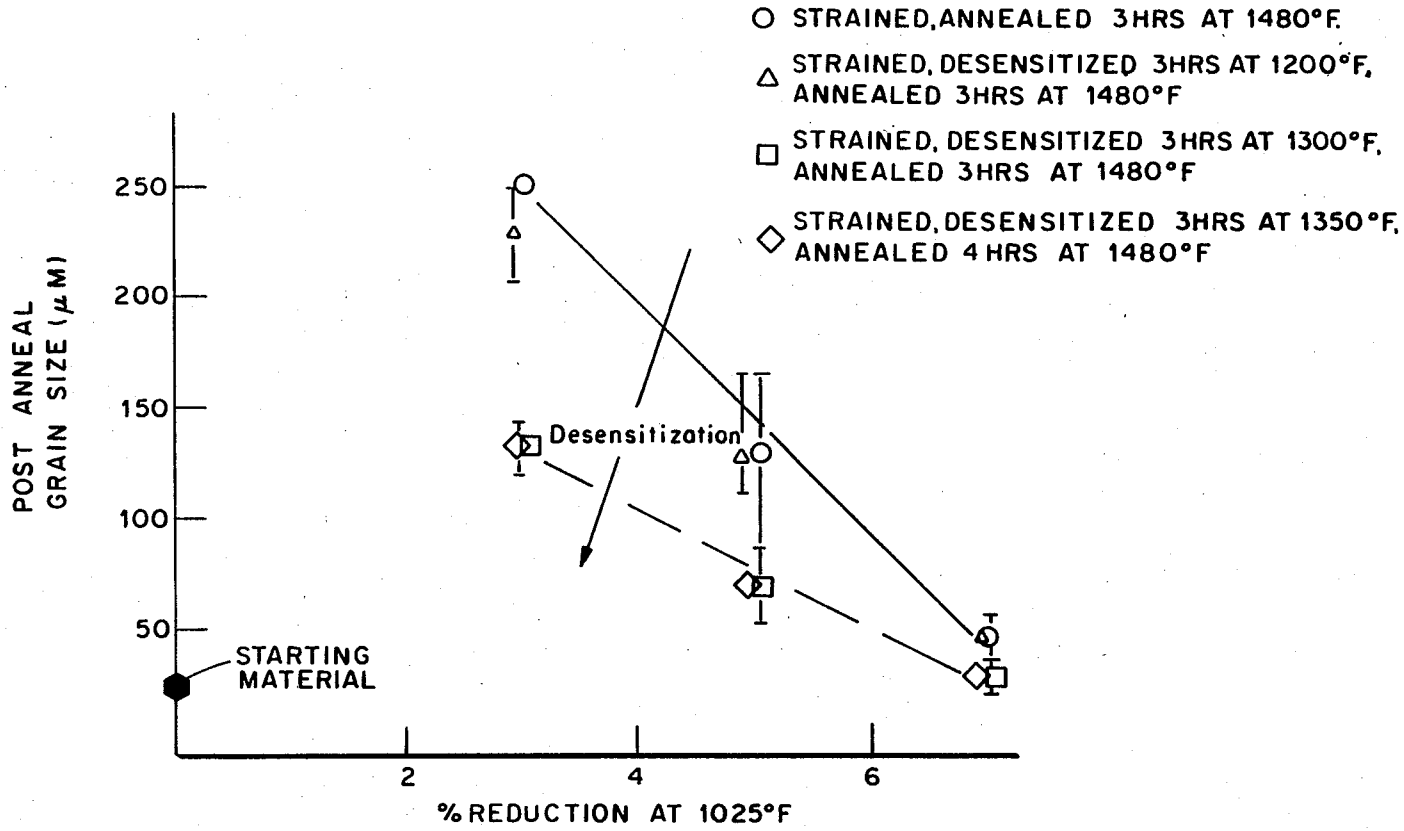
○ STRAINED, ANNEALED 3HRS AT 1480°F.
△ STRAINED, DESENSITIZED 3HRS AT 1200°F, ANNEALED 3HRS AT 1480°F
□ STRAINED, DESENSITIZED 3HRS AT 1300°F, ANNEALED 3HRS AT 1480°F
◇ STRAINED, DESENSITIZED 3HRS AT 1350°F, ANNEALED 4HRS AT 1480°F
Desensitization
STARTING MATERIAL
POST ANNEAL GRAIN SIZE (μM)
250
200
150
100
50
2
4
6
% REDUCTION AT 1025°F

MANUFACTURING PROCESS TO REDUCE LARGE GRAIN GROWTH IN ZIRCONIUM ALLOYS

The U.S. Government has rights in this invention pursuant to Contract No. DE-AC12-76-SN00052 between the U.S. Department of Energy and the General Electric Company.

BACKGROUND OF THE INVENTION

This invention is directed to a method of treating cold-worked zirconium alloys to reduce large grain growth during thermal treatment above the recrystallization temperature of the alloys. In particular, the method of the present invention is directed to desensitizing cold-worked zirconium alloys (e.g., zircaloy-2 or zircaloy-4) to large grain growth during thermal treatment above the recrystallization temperature of the alloy. The desensitized alloys have a specific utility in the fabrication of nuclear reactor fuel elements.

Zirconium based alloys such as zircaloy-2 and zircaloy-4 are commonly used in nuclear reactor fuel element cladding. Among the problems encountered in manufacturing fuel elements from zirconium-based alloys is that the alloys are susceptible to large grain growth (LGG). It has been observed that zirconium based alloys which have experienced cold plastic deformation in the range of about 2 to 8 percent strain, undergo LGG during thermal treatment of the alloy at or above the recrystallization temperature. LGG often results in a fuel element which is undesirable for reactor use because the large grains degrade the mechanical properties and possibly the corrosion resistance of the cladding.

A common approach to avoiding LGG is to assure that any zircaloy experiencing thermal cycles in the recrystallization temperature range does not experience cold working in the critical range of about 2 to 8 percent prior to the thermal treatment. In cases where prior strains are inevitable or where cold working in the critical range occurs during the thermal treatment (i.e., on the way up to the recrystallization temperature), prestraining the material to a level well above the critical range has been used. However, since prestraining can degrade machinability, increase cost or be impractical for some geometries, this process is not always available. The process of the present invention is proposed as an economical and viable alternative to the prestraining treatment.

SUMMARY OF THE INVENTION

It is an object of the present invention to provide a procedure for desensitizing zirconium-based alloys to large grain growth (LGG) during thermal treatment above the recrystallization temperature of the alloy.

It is a further object of the present invention to provide a method for treating zirconium-based alloys which have been cold-worked in the range of 2 to 8 percent strain to reduce large grain growth.

It is another object of the present invention to provide a method for fabricating a zirconium alloy clad nuclear fuel element wherein the zirconium clad is resistant to large grain growth.

Additional objects, advantages and novel features of the invention will be set forth in part in the description which follows, and in part will become apparent to those skilled in the art upon examination of the following or may be learned by the practice of the invention. The objects and advantages of the invention may be realized and attained by means of the instrumentalities and combinations particularly pointed out in the appended claims.

To achieve the foregoing and other objects and in accordance with the present invention, as embodied and broadly described herein the process of the present invention comprises treating cold-worked zirconium alloys to reduce large grain growth during subsequent thermal treatment above the recrystallization temperature of the alloy comprising heating the zirconium alloy at a temperature of about 1300° F. to 1350° F. for about 1 to 3 hours subsequent to cold-working the zirconium alloy and prior to thermal treatment above the recrystallization temperature.

Preferably, the cold worked zirconium alloy is cold worked in the range of about 2 to 8 percent strain.

In a further preferred embodiment of the present invention, the heating is at a temperature of 1300° F. for about 3 hours.

In a still further preferred embodiment of the present invention, the heating is at a temperature of 1350° F. for about 1 hour.

In a further aspect of the present invention, a method of desensitizing cold worked zirconium alloys to large grain growth during thermal treatment above the recrystallization temperature comprises cold working said zirconium alloy in the range of 2 to 8 percent strain, heating said cold worked alloy to a temperature between 1300° to 1350° F. for about 1 to 3 hours, and annealing said heat treated alloy at a temperature of above the recrystallization temperature of said alloy for about 3 to 4 hours.

In a preferred embodiment of this aspect of the present invention, the heating of the cold worked alloy is at 1300° F. for about 3 hours.

In a further preferred embodiment of this aspect of the present invention, the heating of the cold worked alloy is at 1350° F. for about 1 hour.

In another preferred embodiment of this aspect of the present invention, the annealing is selected to occur at a temperature of between 1450° to 1550° F.

In still another preferred embodiment of this aspect of the present invention, the cold working is performed by cold rolling the zirconium based alloy.

In still another preferred aspect of the present invention, the zirconium based alloy is selected from the group consisting of zircaloy-2 and zircaloy-4.

In still another further aspect of the present invention, a method for fabricating zirconium alloy clad nuclear fuel elements comprises cold working the zirconium alloy clad fuel element at a temperature below recrystallization temperature of the alloy, heating the cold worked alloy at a temperature between about 1300° to 1350° F. for about 1 to 3 hours to reduce the susceptibility of cold worked zirconium alloy to large grain growth, and annealing the heat treated zirconium alloy at a temperature above the recrystallization temperature of said alloy.

The method of the present invention is an attractive alternative to the previously described prestraining procedure because it does not have the constraints associated with this prestraining procedure. That is, the process of the present invention does not degrade the machinability of the zirconium based alloy and is practical for all shapes of zirconium based alloys. Accordingly, the process of the present invention provides an almost universal, economic procedure for alleviating the susceptibility of zirconium based alloys to large grain growth during thermal treatment. By substantially eliminating the large grain growth experienced during thermal treatment above recrystallization temperatures, applicant's procedure substantially improves the corrosion resistance and mechanical properties of the zirconium cladding used in the formation of nuclear reactor fuel elements.

BRIEF DESCRIPTION OF THE DRAWING

The accompanying drawing, which is incorporated in and forms a part of the specification illustrates the preferred embodiments of the present invention, and, together with the description, serve to explain the principles of the invention. In the drawing:

The drawing is a graph comparing post anneal grain size versus percent reduction at 1025° F. (cold working) of zircaloy-4 when heat treated in applicant's claimed range and heat treated outside applicant's claimed range.

DETAILED DESCRIPTION OF THE INVENTION

Reference will now be made in detail to the present preferred embodiment of the invention, an example of which is illustrated in the accompanying drawing.

The method of the present invention involves treating a cold-worked zirconium based alloy to reduce large grain growth during thermal treatment above its recrystallization temperature. The method comprises heating the zirconium based alloy at a temperature of between about 1300° F. to 1350° F. for about 1 to 3 hours subsequent to cold working said zirconium based alloy and prior to the thermal treatment above the recrystallization temperature of the alloy. The term "cold work" refers to a process of cold rolling the zirconium based alloy at a temperature of 1025° F. or similar type conditions. The cold rolling maintains the zirconium based alloy at a cold plastic deformation in the range of 2 to 8 percent strain. It has been observed that zirconium based alloys which have been subjected to strain in this range are quite susceptible to large grain growth during subsequent thermal treatment above the recrystallization temperature of zirconium based alloy. Preferably, the zirconium based alloy is selected from the group consisting of zircaloy-4 and zircaloy-2.

With reference to the drawing, the graph shows samples of annealed zircaloy-4 having been cold-worked between 8 inch diameter rolls at 1025° F. and being heated to temperatures of 1200° F., 1300° F., and 1350° F. The legend on the graph indicates the appropriate sample and condition. The results of these experiments as presented in the drawing, show that desensitization thermal treatment between a temperature of 1300° F. and 1350° F. for a time of between 1 and 3 hours was effective in reducing the large grain growth propensity of zircaloy-4. Heat treatment of the zircaloy-4 at 1200° F. is shown in the graph as not being effective in the reduction of large grain growth propensity.

The proposed desensitization (heat treatment) procedure of the present invention is equally applicable to zircaloy-2 or other zirconium based alloys. The advantages of the present invention are that it is an economical and universally practical procedure for elimination of large grain growth in zirconium based alloys. The procedure does not degrade the machinability of zircaloy nor effect the corrosion resistance or mechanical properties of cladding. Accordingly, the attendent disadvantages of the prior art procedures as set forth above have been overcome.

The foregoing description of a preferred embodiment of the invention has been presented for purposes of illustration and description. It is not intended to be exhaustive or to limit the invention as to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A method of treating cold worked zirconium alloys to reduce large grain growth during thermal treatment above its recrystallization temperature comprising heating said zirocinium alloy at a temperature of about 1300° F. to 1350° F. for about 1 to 3 hours subsequent to cold working said zirconium alloy and prior to said thermal treatment at a temperature of between 1450°-1550° F., said thermal treatment temperature being above said recrystallization temperature.

2. The method of claim 1 wherein the cold worked strain is in the range of about 2 to 8 percent.

3. The method of claim 2 wherein said heating is at a temperature of about 1300° F. for about 3 hours.

4. The method of claim 2 wherein said heating is at a temperature of about 1350° F. for 1 hour.

5. The method of desensitizing cold worked zirconium alloys to large grain growth during thermal treatment above its recrystallization temperature comprising (a) cold working said zirconium alloy to cold plastic deformation in the range of about 2 to 8 percent strain;

(b) heating said cold worked alloy to a temperature between 1300° to about 1350° F. for about 1 to 3 hours;

(c) annealing said heat treated alloy at a temperature of between 1450°-1550° F., said annealing temperature being above the recrystallization temperature of said alloy, for about 3 to 4 hours.

6. The method of claim 5 wherein the heating is to about 1300° F. for about 3 hours.

7. The method of claim 5 wherein the heating is to about 1350° F. for about 1 hour.

8. The method of claim 5 wherein the cold working is performed by cold rolling said zirconium alloy at a temperature of about 1025° F.

9. A method for fabraicating a zirconium alloy clad nuclear fuel element comprising:

(a) cold working the zirconium alloy clad fuel element at a temperature below the recrystallizaiton temperature of the alloy;

(b) heating the cold worked alloy at a temperture of between about 1300° to 1350° F. for about 1 to 3 hours to reduce the susceptibility of said cold worked zirconium alloy to large grain growth;

(c) annealing said heat treated zirconium alloy at a temperature of between 1450°-1550° F., said annealing temperature being above the recrystallization temperature of said alloy.

10. The method of claim 9 wherein the zirconium alloy is selected from the group consisting of zircaloy-2 and zircaloy-4.

11. The method of claim 10 wherein the cold worked alloy is heated to a temperature of about 1300° F. for about 3 hours.

12. The method of claim 10 wherein the cold worked alloy is heated to a tempezature of about 1350° F. for about 1 hour.

* * * * *